US010535451B2

(12) United States Patent
Li et al.

(10) Patent No.: US 10,535,451 B2
(45) Date of Patent: Jan. 14, 2020

(54) RARE EARTH-COBALT-BASED COMPOSITE MAGNETIC MATERIAL

(71) Applicant: NINGBO CO-STAR MATERIALS HI-TECH CO., LTD., Ningbo (CN)

(72) Inventors: Ming Li, Ningbo (CN); Daoliang Pan, Ningbo (CN); Guangchun Su, Ningbo (CN); Jian Hu, Ningbo (CN); Yonglin Liang, Ningbo (CN); Shuxia Cheng, Ningbo (CN)

(73) Assignee: NINGBO CO-STAR MATERIALS HI-TECH CO., LTD., Ningbo (CN)

( * ) Notice: Subject to any disclaimer, the term of this patent is extended or adjusted under 35 U.S.C. 154(b) by 290 days.

(21) Appl. No.: 15/589,426

(22) Filed: May 8, 2017

(65) Prior Publication Data

US 2018/0151276 A1 May 31, 2018

(30) Foreign Application Priority Data

Nov. 28, 2016 (CN) ..... 2016 1 1062230

(51) Int. Cl.
*H01F 1/055* (2006.01)

(52) U.S. Cl.
CPC ..... *H01F 1/0557* (2013.01)

(58) Field of Classification Search
None
See application file for complete search history.

(56) References Cited

U.S. PATENT DOCUMENTS

2009/0022992 A1 1/2009 Takami et al.
2011/0241810 A1* 10/2011 Horiuchi ..... C22C 1/0433 335/302

FOREIGN PATENT DOCUMENTS

CN 001433996 A 6/2003
CN 103586465 A 2/2014
JP 02128404 A * 5/1990 ..... H01F 1/0577

OTHER PUBLICATIONS

Machine translation of JP2-128404A. (Year: 1990).*

* cited by examiner

*Primary Examiner* — Xiaowei Su
(74) *Attorney, Agent, or Firm* — Heslin Rothenberg Farley & Mesiti P.C.; Victor A. Cardona, Esq.

(57) ABSTRACT

A rare earth-cobalt-based composite magnetic material includes a rare earth-cobalt-based composite material and rare earth oxides, wherein the mass percent of the rare earth-cobalt-based composite material is 40 wt %-98.55 wt %. The composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment. Low-cost rare earth oxides are introduced, the remanence of the rare earth-cobalt-based material is controlled by controlling the content of the rare earth oxides, and the coercive force of the rare earth-cobalt-based material is raised to reduce the cost by optimizing the micro-structure and the composition.

10 Claims, No Drawings

RARE EARTH-COBALT-BASED COMPOSITE MAGNETIC MATERIAL

CROSS-REFERENCE TO RELATED APPLICATION

This application claims priority to Chinese Patent Application No. CN201611062230.6 filed on Nov. 28, 2016, the entire disclosure of which is incorporated herein by reference.

BACKGROUND OF THE INVENTION

Technical Field

The present invention relates to a rare earth-cobalt-based composite magnetic material and belongs to the technical field of magnetic materials.

Description of Related Art

In recent years, the continuous development of functional materials has effectively promoted the progress of human society. As one of the functional materials, permanent magnetic materials have now been widely applied in the present information society for their function of energy conversion and various magnetic physics effects. At present, rare-earth permanent magnetic materials are known to have the highest comprehensive properties, with a magnetic property 100 times higher than that of magnetic steel and much superior to ferrite and alnico in properties. Application of rare-earth materials not only makes permanent magnet devices small-sized and improves the performance of products, but also brings some special devices into existence. So, once the rare-earth materials were discovered, they attracted attention from many countries and experienced rapid development. The rare-earth permanent magnetic material is divided into three categories by the composition: 1. rare earth-cobalt permanent material, comprising rare earth-cobalt (1-5 type) permanent magnetic material $SmCo_5$ and rare earth-cobalt (2-17 type) permanent magnetic material $Sm_2Co_{17}$; 2. rare earth-neodymium permanent material, NdFeB permanent material; 3. rare earth-Fe—N (RE-Fe—N series) or rare earth-Fe-carbon (RE-Fe—C series) permanent materials. The rare earth-cobalt-based material is an excellent high-temperature permanent material. With a high Curie temperature (700° C.-900° C.), a high coercive force (>25 kOe) and good temperature stability, the rare earth-cobalt-based material plays an irreplaceable role in the field of high temperature and high stability, and now is widely applied in rail transit, military, aeronautics and astronautic and other fields.

The samarium-cobalt permanent magnet came out with a high magnetic energy product and a reliable coercive force in the 1960s and is divided into $SmCo_5$ and $Sm_2Co_{17}$ by composition, i.e. Generation I rare-earth permanent materials and Generation II rare-earth permanent materials. The scarcity and high price of its raw materials, samarium and strategic metal cobalt which have a rare storage, limits its development. With the development of the neodymium magnet material, the samarium-cobalt permanent magnet was applied in fewer fields. However, the samarium-cobalt permanent magnet has good temperature characteristics in the rare-earth permanent magnetic series. Compared with NdFeB, samarium-cobalt is more suitable for a high temperature environment, so it is still widely applied in various high-temperature severe environments such as military industry technologies.

The properties of the samarium-cobalt permanent magnet are closely related with the structure and size of magnetic powders. For anisotropic permanent magnets, the magnetocrystalline in such magnets is arranged in the direction of the easy magnetization axis, so the magnets have good anisotropy and magnetic properties; besides, permanent magnetic alloys have a high coercive force for the size effect of their crystalline grains, and they are one of the development directions of samarium-cobalt permanent magnetic materials in order to prepare the permanent magnetic alloy with a small grain size and thereby raise the coercive force. For magnetically hard materials, an important condition for obtaining a high remanent magnetization is that the magnetocrystalline has strong anisotropy.

It is well known that although the high-temperature magnetic properties and temperature stability of the rare earth-cobalt-based material are obviously better than those of the neodymium magnet material, the rare earth-cobalt-based material has poor mechanical properties, exhibiting fragility and easy fall-off of corners and pieces, which greatly affects the machinability and usability, reducing the production yield and restricting its use range. The rare earth-cobalt magnet has different mechanical properties in the direction of magnetization and in the direction perpendicular to the direction of magnetization respectively, exhibiting obvious mechanical anisotropy. Generally speaking, the mechanical properties in the direction perpendicular to the direction of magnetization are obviously poorer than those in the direction of magnetization, therefore the effective path to solve the problem is to improve the mechanical properties of the rare earth-cobalt magnet in the direction perpendicular to the direction of magnetization. The rare earth-cobalt-based material exhibits fragility for its special crystal structure-like ceramic materials, so it is difficult to improve its mechanical properties through improvement of heat treatment processes only. In addition, those skilled in the field generally believe that too much rare earth oxides will severely worsen the magnetic properties of the rare earth-cobalt-based material, so in actual preparation of the rare earth-cobalt-based material, oxygen is strictly controlled and the oxygen content for the rare earth-cobalt-based material is generally 1000 ppm-3500 ppm.

BRIEF SUMMARY OF THE INVENTION

The objective of the present invention is to provide a rare earth-cobalt-based composite magnetic material with excellent mechanical properties for the technical problems in the prior art.

The objective of the present invention is realized through the following technical solution: a rare earth-cobalt-based composite magnetic material, comprising a rare earth-cobalt-based composite material and rare earth oxides, wherein the mass percent of the rare earth-cobalt-based composite material is 40 wt %-98.55 wt %;

The composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

In the present invention, low-cost rare earth oxides are introduced, the remanence of the rare earth-cobalt-based material is controlled by controlling the content of the rare earth oxides to prepare different designations of magnets, and the coercive force of magnets is raised by optimizing the micro-structure and the composition; compared with the same designation of magnets commercially available, the mechanical properties of the rare earth-cobalt-based composite magnetic material is significantly improved while the raw material cost is greatly reduced. The cost of raw materials can be reduced by 5%-30%. The more rare earth oxides are added, the more the cost is reduced. However, those skilled in the present invention find that an overly high content of the rare earth oxides, exceeding the upper limit set in the present invention, is not favorable to sintering densification and will not raise the mechanical properties obviously, but will affect the mechanical properties. Preferably, the percent of the rare earth oxides in the magnetic material is 1 wt %-30 wt %.

In the rare earth-cobalt-based composite material described above, the rare earth oxides comprise endogenous rare earth oxides from the oxidization of the rare earth element in the rare earth-cobalt-based composite material and added rare earth oxides. The mass percent of the endogenous rare earth oxides in the rare earth-cobalt-based composite magnetic material does not exceed 3.0 wt %. The total content of the oxygen introduced by the rare earth oxides is 3000 ppm-50000 ppm. In the prior art, in order to avoid worsening the magnetic properties, the oxygen content of the rare earth-cobalt-based material is strictly controlled at 1000 ppm-3500 ppm in general, while in accordance with the present invention, the rare earth oxides in the rare earth-cobalt-based composite magnetic material are divided into endogenous rare earth oxides and added rare earth oxides. In addition to the generation of endogenous rare earth oxides, rare earth oxides are added to increase the amount of second-phase oxides so as to improve the mechanical properties of the rare earth-cobalt-based material and reduce the cost. Besides, the magnetic properties are much less worsened by rare earth oxides through adjustment of the composition and the preparation processes in the later stage, which removes the necessity of strictly controlling the oxygen content to avoid worsening the magnetic properties in the prior art and improves the mechanical properties.

Preferably, in the rare earth-cobalt-based composite magnetic material, the content of the oxygen introduced by endogenous rare earth oxides does not exceed 5000 ppm, and the remaining oxygen content is introduced by the addition of rare earth oxides.

In the rare earth-cobalt-based composite magnetic material, the rare earth oxides also contain the element Co which is 0.1 wt %-10 wt % of the total mass of the rare earth oxides.

In the rare earth-cobalt-based composite magnetic material, the rare earth-cobalt-based composite material also comprises Sn, wherein the content of Sn in the rare earth-cobalt-based composite material does not exceed 10 wt %. In accordance with the present invention, a proper amount of low-melting point tin powder is added to improve the sintering densification of raw materials and thereby provide magnets which have high mechanical properties. Preferably, the amount of Sn added in the rare earth-cobalt-based composite material is 0 wt %-5 wt % (mass fraction in the matrix)

Preferably, the average size of Sn is 3-400 microns. More preferably, the average size of Sn is 5-100 microns. Addition of a proper amount of Sn powders in the rare earth-cobalt-based composite material in accordance with the present invention can significantly improve the binding capacity.

In the rare earth-cobalt-based composite magnetic material, the rare earth-cobalt-based composite material is melted and cast into ingots, and the ingots include main alloy ingots A and auxiliary alloy ingots B.

The stoichiometric equation of chemical atoms of the main alloy ingots is $(SmR_1)(CoM_1)z$, wherein $R_1$ is one or more of Y, La, Ce, Pr, Nd, Eu, Gd, Tb, Dy, Ho, Er, Tm, Yb and Lu, $M_1$ is one or more of Fe, Cu, Zr, Mn, Ni, Ti, V, Cr, Zn, Nb, Mo, Hf, W and Sn, and z is 4.0-9.0;

The stoichiometric equation of chemical atoms of the main alloy ingots is $(SmR_2)(CoM_2)y$, wherein $R_2$ is one or more of Y, La, Ce, Pr, Nd, Eu, Gd, Tb, Dy, Ho, Er, Tm, Yb and Lu, $M_2$ is one or more of Fe, Cu, Zr, Mn, Ni, Ti, V, Cr, Zn, Nb, Mo, Hf, W and Sn, and y is 0.3-1.

In the rare earth-cobalt-based composite magnetic material, the specific steps of the hydrogen decrepitation are that the ingots absorb hydrogen for 2 h-5 h at a decrepitation temperature of 10° C.-180° C. and a hydrogen pressure of 0.2 Mpa-0.5 MPa, and then are subjected to vacuum dehydrogenation for 2 h-5 h at a temperature of 200° C.-600° C.

Further, hydrogen decrepitated powders A and hydrogen decrepitated powders B are obtained from the main alloy ingots A and the auxiliary alloy ingots B through the hydrogen decrepitation, and at least one of the hydrogen decrepitated powders A and hydrogen decrepitated powders B has an average size of 10-500 microns.

Furthermore, rare earth oxides are added to the hydrogen decrepitated powders A and mixed with the same by stirring, and then jet milled to obtain magnetic powders D; the average size of the magnetic powders D is 2-6 microns.

Furthermore, the hydrogen decrepitated powders B are jet milled to obtain magnetic powders B; the average size of the magnetic powders B is 2-6 microns.

Furthermore, Sn powders E are added to the magnetic powders D and the magnetic powders B and blended for 3-6 h to obtain magnetic powders F; calculated as the mass fraction in the total raw materials of the rare earth-cobalt-based composite magnetic material, the amount of Sn powders added does not exceed 10 wt %, the amount of the magnetic powders B added does not exceed 10 wt %, and the sum of the amounts of both added powders does not exceed 10 wt %.

Commercially available rare earth oxides are powders and the average size is several microns. In the present invention, the rare earth oxides, acting as lubricants in jet milling, are mixed with the hydrogen decrepitated powders for jet milling, which can significantly improve the milling efficiency of the jet mill and raise the yield to 30-60%, reducing the preparation cost.

In the rare earth-cobalt-based composite magnetic material, the magnetic powders F are oriented and molded; undergo cold isostatic pressing to obtain blanks; and undergo heat treatment to obtain the rare earth-cobalt-based composite magnetic material, wherein the heat treatment process is that the blanks obtained from the cold isostatic pressing are heated to 1100° C.-1250° C. for 1-6 h heat treatment, cooled to 800° C.-1200° C. at a cooling rate of 0.1° C./min-4° C./min, maintained at the temperature for 0-5 h, and air-cooled to room temperature.

Further, the magnetic powders F are oriented and molded; undergo cold isostatic pressing to obtain blanks; and undergo heat treatment to obtain the rare earth-cobalt-based composite magnetic material, wherein the heat treatment process is that the blanks obtained from the cold isostatic pressing are heated to 1100° C.-1250° C. for 1-6 h heat treatment, cooled to 800° C.-1200° C. at a cooling rate of 0.1° C./min-4° C./min, maintained at the temperature for not more than 15 h, and air-cooled to the room temperature, and then maintained at a temperature of 750° C.-900° C. for 5-40 h, slowly cooled to 350° C.-600° C. at a cooling rate of 0.1°

C./min-4° C./min, maintained for not more than 10 h, and air-cooled to room temperature.

The present invention has the following advantages compared with the prior art:

1. Low-cost rare earth oxides are introduced, the remanence of the rare earth-cobalt-based material is controlled by controlling the content of the rare earth oxides, and the coercive force of the rare earth-cobalt-based material is raised to reduce the cost by optimizing the micro-structure and the composition.

2. In the rare earth-cobalt-based composite magnetic material of the present invention, in addition to the generation of endogenous rare earth oxides, rare earth oxides are added to increase the amount of second-phase oxides so as to improve the mechanical properties of the rare earth-cobalt-based material, which removes the necessity of strictly controlling the oxygen content to avoid worsening the magnetic properties in the prior art.

3. In the present invention, the rare earth-cobalt-based composite material is melted and cast into ingots; different alloy ingots undergo hydrogen decrepitation, hydrogen decrepitated main alloy powders are mixed with the rare earth oxides, jet-milled, and then blended with auxiliary alloy magnetic powders. The rare earth oxides, acting as lubricants in jet milling, are mixed with the hydrogen decrepitated powders for jet milling, which can significantly improve the milling efficiency of the jet mill and reduce the preparation cost.

4. For the rare earth-cobalt-based composite magnetic material of the present invention, multiple times of maintenance at different temperatures and cooling further improves the mechanical properties of the rare earth-cobalt-based composite magnetic material, especially those in the direction perpendicular to the direction of magnetization, in the cold isostatic pressing.

DETAILED DESCRIPTION OF THE INVENTION

The technical solution of the present invention will be further described hereinafter with the embodiments, but the present invention is not limited to these embodiments.

Embodiment 1

A rare earth-cobalt-based composite magnetic material comprises 90 wt % of rare earth-cobalt-based composite materials and rare earth oxides, and is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 2

A rare earth-cobalt-based composite magnetic material comprises 60 wt % of rare earth-cobalt-based composite materials and rare earth oxides, and is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 3

A rare earth-cobalt-based composite magnetic material comprises 89 wt % of rare earth-cobalt-based composite materials and rare earth oxides, wherein the rare earth oxides comprise 10 wt % (percent in the total mass of the rare earth-cobalt-based composite magnetic material) of added rare earth oxides and endogenous rare earth oxides from the oxidization of the rare earth element in the rare earth-cobalt-based composite material and, wherein the mass percent of the endogenous rare earth oxides in the rare earth-cobalt-based composite magnetic material does not exceed 3.0 wt %; the total content of the oxygen introduced by the rare earth oxides is 3000 ppm-50000 ppm. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 4

A rare earth-cobalt-based composite magnetic material comprises 68 wt % of rare earth-cobalt-based composite materials and rare earth oxides, wherein the rare earth oxides comprise 30 wt % (percent in the total mass of the rare earth-cobalt-based composite magnetic material) of added rare earth oxides and endogenous rare earth oxides from the oxidization of the rare earth element in the rare earth-cobalt-based composite material and, the mass percent of the endogenous rare earth oxides in the rare earth-cobalt-based composite magnetic material does not exceed 3.0 wt %; the total content of the oxygen introduced by the rare earth oxides is 3000 ppm-50000 ppm, the content of the oxygen introduced by endogenous rare earth oxides does not exceed 5000 ppm, and the remaining oxygen content is introduced by the addition of rare earth oxides. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 5

A rare earth-cobalt-based composite magnetic material comprises 50 wt % of rare earth-cobalt-based composite materials and rare earth oxides; the rare earth oxides also contain the element Co which is 6 wt % of the total mass of the rare earth oxides; the rare earth oxides comprise 48.5 wt % (percent in the total mass of the rare earth-cobalt-based composite magnetic material) of added rare earth oxides and endogenous rare earth oxides from the oxidization of the rare earth element in the rare earth-cobalt-based composite material and, wherein the mass percent of the endogenous rare earth oxides in the rare earth-cobalt-based composite magnetic material does not exceed 3.0 wt %; the total content of the oxygen introduced by the rare earth oxides is 3000 ppm-50000 ppm, the content of the oxygen introduced by endogenous rare earth oxides does not exceed 5000 ppm, and the remaining oxygen content is introduced by the addition of rare earth oxides. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 6

A rare earth-cobalt-based composite magnetic material comprises 97 wt % of rare earth-cobalt-based composite materials and rare earth oxides; the rare earth oxides also contain the element Co which is 2 wt % of the total mass of the rare earth oxides; the rare earth oxides comprise 1.8 wt % (percent in the total mass of the rare earth-cobalt-based composite magnetic material) of added rare earth oxides and endogenous rare earth oxides from the oxidization of the rare earth element in the rare earth-cobalt-based composite material and, wherein the mass percent of the endogenous rare earth oxides in the rare earth-cobalt-based composite magnetic material does not exceed 3.0 wt %; the total content of the oxygen introduced by the rare earth oxides is 3000 ppm-50000 ppm, the content of the oxygen introduced by endogenous rare earth oxides does not exceed 5000 ppm, and the remaining oxygen content is introduced by the addition of rare earth oxides. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 7

A rare earth-cobalt-based composite magnetic material comprises 95 wt % of rare earth-cobalt-based composite materials and rare earth oxides; the rare earth-cobalt-based composite material also comprises Sn, wherein the content of Sn in the rare earth-cobalt-based composite material does not exceed 10 wt %; the rare earth oxides also contain the element Co which is 1 wt % of the total mass of the rare earth oxides; the rare earth oxides comprise 4.2 wt % (percent in the total mass of the rare earth-cobalt-based composite magnetic material) of added rare earth oxides and endogenous rare earth oxides from the oxidization of the rare earth element in the rare earth-cobalt-based composite material and, wherein the mass percent of the endogenous rare earth oxides in the rare earth-cobalt-based composite magnetic material does not exceed 3.0 wt %; the total content of the oxygen introduced by the rare earth oxides is 3000 ppm-50000 ppm, the content of the oxygen introduced by endogenous rare earth oxides does not exceed 5000 ppm, and the remaining oxygen content is introduced by the addition of rare earth oxides. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 8

A rare earth-cobalt-based composite magnetic material comprises 79 wt % of rare earth-cobalt-based composite materials and rare earth oxides; the rare earth-cobalt-based composite material also comprises Sn, wherein the content of Sn in the rare earth-cobalt-based composite material does not exceed 10 wt %; the rare earth oxides also contain the element Co which is 8 wt % of the total mass of the rare earth oxides; the rare earth oxides comprise 20 wt % (percent in the total mass of the rare earth-cobalt-based composite magnetic material) of added rare earth oxides and endogenous rare earth oxides from the oxidization of the rare earth element in the rare earth-cobalt-based composite material and, wherein the mass percent of the endogenous rare earth oxides in the rare earth-cobalt-based composite magnetic material does not exceed 3.0 wt %; the total content of the oxygen introduced by the rare earth oxides is 3000 ppm-50000 ppm, the content of the oxygen introduced by endogenous rare earth oxides does not exceed 5000 ppm, and the remaining oxygen content is introduced by the addition of rare earth oxides. The rare earth-cobalt-based composite magnetic material is obtained by melting and casting the rare earth-cobalt-based composite material into ingots, hydrogen decrepitation and the addition of the rare earth oxides, jet milling, blending, orientation and molding, cold isostatic pressing and heat treatment.

Embodiment 9

The rare earth-cobalt-based composite material described in Embodiment 1 is melted, the molten metal is poured into rolling water-cooled copper molds under the protection of argon atmosphere to obtain 5 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Y, La, Tb, $M_1$ is Fe and z is 4.0; the stoichiometric equation of chemical atoms of the auxiliary alloy ingots B is $(SmR_2)(CoM_2)y$, wherein $R_2$ is Ce and Gd, $M_2$ is Cu, Zr, Mn and Sn, and y is 0.3.

The main alloy casting strips A and the auxiliary alloy casting strip B are allowed to absorb hydrogen for 5 h at room temperature and a hydrogen pressure of 0.2 MPa, and then are subjected to vacuum dehydrogenation for 5 h at a temperature of 200° C., to obtain hydrogen decrepitated powders A with an average size of 10 microns and hydrogen decrepitated powders B with an average size of 10 microns.

85 wt % of hydrogen decrepitated powders A and 15 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

94 wt % of magnetic powders D (calculated as the percent in the total mass of the magnetic powders F) and 5 wt % of magnetic powders B (calculated as the percent in the total mass of the magnetic powders F) are mixed, 1 wt % of Sn powder (calculated as the percent in the total mass of the magnetic powders F) is added, and the mixture is stirred for 3 h to obtain final magnetic powders F.

The magnetic powders F are oriented and molded in a 1.0 T magnetic field, and undergo cold isostatic pressing under a pressure of 150 MPa to obtain blanks; the blanks are heated to 1100° C. for 6 h heat treatment, cooled to 800° C. at a cooling rate of 4° C./min, maintained at the temperature for 5 h, and air-cooled to room temperature, to obtain the rare earth-cobalt-based composite material.

Embodiment 10

The rare earth-cobalt-based composite material described in Embodiment 2 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Y, Ce and Yb, $M_1$ is Cu, and z is 9.0; the stoichiometric equation of chemical atoms of the auxiliary alloy ingots B is $(SmR_2)(CoM_2)y$, wherein $R_2$ is Ce and Gd, $M_2$ is Cu, Zr, Mn and Sn, and y is 1.

The main alloy casting strips A and the auxiliary alloy casting strip B are allowed to absorb hydrogen for 2 h at room temperature and a hydrogen pressure of 0.5 MPa, and then are subjected to vacuum dehydrogenation for 2 h at a temperature of 400° C., to obtain hydrogen decrepitated powders A with an average size of 200 microns and hydrogen decrepitated powders B with an average size of 500 microns.

80 wt % of hydrogen decrepitated powders A and 20 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

96 wt % of magnetic powders D (calculated as the percent in the total mass of the magnetic powders F) and 3 wt % of magnetic powders B (calculated as the percent in the total mass of the magnetic powders F) are mixed, 3 wt % of Sn powder (calculated as the percent in the total mass of the magnetic powders F) is added, and the mixture is stirred for 3 h to obtain final magnetic powders F.

The magnetic powders F are oriented and molded in a 2.0 T magnetic field, and undergo cold isostatic pressing under a pressure of 240 MPa to obtain blanks; the blanks are heated to 1250° C. for 1 h heat treatment, cooled to 1200° C. at a cooling rate of 3.8° C./min, maintained at the temperature for 5 h, and air-cooled to room temperature, to obtain the rare earth-cobalt-based composite material.

Embodiment 11

The rare earth-cobalt-based composite material described in Embodiment 3 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Y, La, Tb, $M_1$ is Fe and z is 8.0; the stoichiometric equation of chemical atoms of the auxiliary alloy ingots B is $(SmR_2)(CoM_2)y$, wherein $R_2$ is Ce, $M_2$ is Zr and Mn, and y is 0.8.

The main alloy casting strips A and the auxiliary alloy casting strip B are allowed to absorb hydrogen for 4 h at room temperature and a hydrogen pressure of 0.3 MPa, and then are subjected to vacuum dehydrogenation for 4 h at a temperature of 250° C., to obtain hydrogen decrepitated powders A with an average size of 50 microns and hydrogen decrepitated powders B with an average size of 40 microns.

89.4 wt % of hydrogen decrepitated powders A and 10.6 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

94 wt % of magnetic powders D (calculated as the percent in the total mass of the magnetic powders F) and 2 wt % of magnetic powders B (calculated as the percent in the total mass of the magnetic powders F) are mixed, 4 wt % of Sn powder (calculated as the percent in the total mass of the magnetic powders F) is added, and the mixture is stirred for 3 h to obtain final magnetic powders F.

The magnetic powders F are oriented and molded in a 1.8 T magnetic field, and undergo cold isostatic pressing under a pressure of 230 MPa to obtain blanks; the blanks are heated to 1150° C. for 5 h heat treatment, cooled to 920° C. at a cooling rate of 1.2° C./min, maintained at the temperature for 1 h, and air-cooled to room temperature, to obtain the rare earth-cobalt-based composite material.

Embodiment 12

The rare earth-cobalt-based composite material described in Embodiment 4 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Y, La and Ce, $M_1$ is Fe and Cu, and z is 7.0; the stoichiometric equation of chemical atoms of the auxiliary alloy ingots B is $(SmR_2)(CoM_2)y$, wherein $R_2$ is Ce, $M_2$ is Zr and Mn, and y is 0.5.

The main alloy casting strips A and the auxiliary alloy casting strip B are allowed to absorb hydrogen for 3 h at room temperature and a hydrogen pressure of 0.3 MPa, and then are subjected to vacuum dehydrogenation for 3 h at a temperature of 350° C., to obtain hydrogen decrepitated powders A with an average size of 80 microns and hydrogen decrepitated powders B with an average size of 400 microns.

66.6 wt % of hydrogen decrepitated powders A and 33.3 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

90 wt % of magnetic powders D (calculated as the percent in the total mass of the magnetic powders F) and 6 wt % of magnetic powders B (calculated as the percent in the total mass of the magnetic powders F) are mixed, 4 wt % of Sn powder (calculated as the percent in the total mass of the magnetic powders F) is added, and the mixture is stirred for 4 h to obtain final magnetic powders F.

The magnetic powders F are oriented and molded in a 1.3 T magnetic field, and undergo cold isostatic pressing under a pressure of 220 MPa to obtain blanks; the blanks are heated to 1230° C. for 1 h heat treatment, cooled to 1180° C. at a cooling rate of 0.8° C./min, maintained at the temperature for 0 h, and air-cooled to room temperature, to obtain the rare earth-cobalt-based composite material.

Embodiment 13

The rare earth-cobalt-based composite material described in Embodiment 5 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Ce and Pr, $M_1$ is Fe, Cu, Zr and Mn, and z is 4.2; the stoichiometric equation of chemical atoms of the auxiliary alloy ingots B is $(SmR_2)(CoM_2)y$, wherein $R_2$ is Y and La, $M_2$ is Fe and Sn, and y is 0.4.

The main alloy casting strips A and the auxiliary alloy casting strip B are allowed to absorb hydrogen for 4.5 h at room temperature and a hydrogen pressure of 0.25 MPa, and then are subjected to vacuum dehydrogenation for 4.5 h at a temperature of 220° C., to obtain hydrogen decrepitated powders A with an average size of 300 microns and hydrogen decrepitated powders B with an average size of 200 microns.

50 wt % of hydrogen decrepitated powders A and 50 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

97 wt % of magnetic powders D (calculated as the percent in the total mass of the magnetic powders F) and 2 wt % of magnetic powders B (calculated as the percent in the total mass of the magnetic powders F) are mixed, 1 wt % of Sn powder (calculated as the percent in the total mass of the magnetic powders F) is added, and the mixture is stirred for 4 h to obtain final magnetic powders F.

The magnetic powders F are oriented and molded in a 1.6 T magnetic field, and undergo cold isostatic pressing under a pressure of 190 MPa to obtain blanks; the blanks are heated to 1220° C. for 1.5 h heat treatment, cooled to 1160° C. at a cooling rate of 3.5° C./min, maintained at the temperature for 1 h, and air-cooled to room temperature, to obtain the rare earth-cobalt-based composite material.

Embodiment 14

The rare earth-cobalt-based composite material described in Embodiment 6 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Ce and Pr, $M_1$ is Fe, Cu, Zr and Mn, and z is 4.5; the stoichiometric equation of chemical atoms of the auxiliary alloy ingots B is $(SmR_2)(CoM_2)y$, wherein $R_2$ is Y and La, $M_2$ is Fe and Sn, and y is 0.7.

The main alloy casting strips A and the auxiliary alloy casting strip B are allowed to absorb hydrogen for 4.5 h at room temperature and a hydrogen pressure of 0.25 MPa, and then are subjected to vacuum dehydrogenation for 2.2 h at a temperature of 380° C., to obtain hydrogen decrepitated powders A with an average size of 80 microns and hydrogen decrepitated powders B with an average size of 180 microns.

81.25 wt % of hydrogen decrepitated powders A and 18.75 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

96 wt % of magnetic powders D (calculated as the percent in the total mass of the magnetic powders F) and 2 wt % of magnetic powders B (calculated as the percent in the total mass of the magnetic powders F) are mixed, 2 wt % of Sn powder (calculated as the percent in the total mass of the magnetic powders F) is added, and the mixture is stirred for 4 h to obtain final magnetic powders F.

The magnetic powders F are oriented and molded in a 1.6 T magnetic field, and undergo cold isostatic pressing under a pressure of 220 MPa to obtain blanks; the blanks are heated to 1180° C. for 5 h sintering, cooled to 940° C. at a cooling rate of 2.8° C./min, maintained at the temperature for 1 h, and air-cooled to room temperature, and then maintained at a temperature of 820° C. for 6 h, slowly cooled to 450° C. at a cooling rate of 2.5° C./min, and maintained for 6 h, to obtain the rare earth-cobalt-based composite material.

Embodiment 15

The rare earth-cobalt-based composite material described in Embodiment 7 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Ce, $M_1$ is Fe, Cu, Zr and Mn, and z is 6.0; the stoichiometric equation of chemical atoms of the auxiliary alloy ingots B is $(SmR_2)(CoM_2)y$, wherein $R_2$ is Ce, $M_2$ is Cu and Sn, and y is 0.8.

The main alloy casting strips A and the auxiliary alloy casting strip B are allowed to absorb hydrogen for 2.5 h at room temperature and a hydrogen pressure of 0.45 MPa, and then are subjected to vacuum dehydrogenation for 2.8 h at a temperature of 330° C., to obtain hydrogen decrepitated powders A with an average size of 250 microns and hydrogen decrepitated powders B with an average size of 200 microns.

55.4 wt % of hydrogen decrepitated powders A and 44.6 wt % of samarium oxides are mixed, stirred for 3 h and jet-milled to obtain magnetic powders with an average size of 2-6 microns.

Hydrogen decrepitated powders B are jet-milled to obtain magnetic powders with an average size of 2-6 microns.

94 wt % of magnetic powders D (calculated as the percent in the total mass of the magnetic powders F) and 1 wt % of magnetic powders B (calculated as the percent in the total mass of the magnetic powders F) are mixed, 5 wt % of Sn powder (calculated as the percent in the total mass of the magnetic powders F) is added, and the mixture is stirred for 3 h to obtain final magnetic powders F.

The magnetic powders F are oriented and molded in a 1.4 T magnetic field, and undergo cold isostatic pressing under a pressure of 180 MPa to obtain blanks; the blanks are heated to 1220° C. for 3 h sintering, cooled to 880° C. at a cooling rate of 2.2° C./min, maintained at the temperature for 2.5 h, and air-cooled to room temperature, and then maintained at a temperature of 850° C. for 20 h, slowly cooled to 550° C. at a cooling rate of 1.2° C./min, and maintained for 6 h, to obtain the rare earth-cobalt-based composite material.

Embodiment 16

The rare earth-cobalt-based composite material described in Embodiment 8 is melted, the molten metal is poured into rolling water-cooled copper molds under the protection of an argon atmosphere to obtain 6 mm thick main alloy casting strips A and auxiliary alloy casting strips B. Wherein, the stoichiometric equation of chemical atoms of the main alloy ingots A is $(SmR_1)(CoM_1)z$, wherein $R_1$ is Ce, $M_1$ is Fe, Cu, Zr and Mn, and z is 5.0; the stoichiometric equation of chemical atoms of the auxiliary alloy ingots B is $(SmR_2)(CoM_2)y$, wherein $R_2$ is Ce, $M_2$ is Cu and Sn, and y is 0.5.

The main alloy casting strips A and the auxiliary alloy casting strip B are allowed to absorb hydrogen for 3.5 h at room temperature and a hydrogen pressure of 0.35 MPa, and then are subjected to vacuum dehydrogenation for 3.5 h at a temperature of 300° C., to obtain hydrogen decrepitated powders A with an average size of 100 microns and hydrogen decrepitated powders B with an average size of 100 microns.

78.3 wt % of hydrogen decrepitated powders A (calculated as the percent in the total mass of the magnetic powders D) and 21.7 wt % of samarium oxides (calculated as the percent in the total mass of the magnetic powders D) are mixed, stirred for 3 h and jet-milled to obtain magnetic powders D with an average size of 2-6 microns.

Hydrogen decrepitated powders B are jet-milled to obtain magnetic powders with an average size of 2-6 microns.

92 wt % of magnetic powders D (calculated as the percent in the total mass of the magnetic powders F) and 4 wt % of magnetic powders B (calculated as the percent in the total mass of the magnetic powders F) are mixed, 4 wt % of Sn powder (calculated as the percent in the total mass of the magnetic powders F) is added, and the mixture is stirred for 3 h to obtain final magnetic powders F.

The magnetic powders F are oriented and molded in a 1.5 T magnetic field, and undergo cold isostatic pressing under a pressure of 200 MPa to obtain blanks; the blanks are heated to 1200° C. for 3 h sintering, cooled to 1000° C. at a cooling rate of 1.2° C./min, maintained at the temperature for 0-5 h, and air-cooled to room temperature, and then maintained at a temperature of 820° C. for 8 h, slowly cooled to 440° C. at a cooling rate of 11.5° C./min, and maintained for 5 h, to obtain the rare earth-cobalt-based composite material.

Contrastive Example 1

Contrastive example 1 is 2:17 type rare earth-cobalt-based materials commercially available and the magnetic energy product is 28 MGOe.

Contrastive Example 2

Contrastive example 2 is 2:17 type rare earth-cobalt-based materials commercially available and the magnetic energy product is 20 MGOe.

Contrastive Example 3

Contrastive example 3 is 1:5 type rare earth-cobalt-based materials commercially available and the magnetic energy product is 19 MGOe.

Contrastive Example 4

The difference between Contrastive 4 and Embodiment 8 is that no samarium oxide powder is added in Contrastive 4.

Contrastive Example 5

The difference between Contrastive 5 and Embodiment 8 is that no Sn powder is added in Contrastive 5.

The property tests of the rare earth-cobalt-based composite materials in Embodiments 1-16 and Contrastive examples 1-5 have the results shown in Table 1.

TABLE 1 the properties of the rare earth-cobalt-based composite materials in Embodiments 1-16 and Contrastive examples 1-5

| Embodiment | Br (kGs) | Hcj (kOe) | $(BH)_m$ (MGOe) | Bending strength (MPa) | Compressive strength (MPa) | Fracture toughness ($MPa \cdot m^{1/2}$) | Oxygen content (ppm) | Density ($g/cm^3$) |
|---|---|---|---|---|---|---|---|---|
| Embodiment 1 | 9.68 | 20.32 | 20.06 | 202 | 728 | 3.25 | 28200 | 8.35 |
| Embodiment 2 | 9.82 | 20.10 | 20.95 | 215 | 724 | 3.3 | 28650 | 8.36 |
| Embodiment 3 | 10.64 | 19.83 | 21.22 | 207 | 728 | 3.46 | 28900 | 8.37 |
| Embodiment 4 | 10.11 | 19.53 | 20.26 | 212 | 732 | 3.55 | 29410 | 8.38 |
| Embodiment 5 | 10.55 | 20.28 | 27.20 | 210 | 724 | 3.5 | 22600 | 8.38 |
| Embodiment 6 | 9.20 | 19.25 | 19.91 | 215 | 735 | 3.81 | 29440 | 8.39 |
| Embodiment 7 | 10.02 | 18.68 | 19.62 | 210 | 733 | 3.78 | 31050 | 8.38 |
| Embodiment 8 | 9.20 | 19.45 | 20.04 | 215 | 735 | 3.80 | 29740 | 8.39 |
| Embodiment 9 | 9.65 | 19.88 | 20.15 | 205 | 736 | 3.26 | 28220 | 8.35 |
| Embodiment 10 | 9.88 | 19.76 | 20.78 | 216 | 728 | 3.32 | 28450 | 8.36 |
| Embodiment 11 | 10.58 | 19.35 | 21.24 | 208 | 730 | 3.47 | 29310 | 8.37 |
| Embodiment 12 | 10.62 | 19.12 | 20.32 | 215 | 740 | 3.58 | 29520 | 8.38 |
| Embodiment 13 | 10.84 | 20.22 | 27.40 | 218 | 736 | 3.6 | 25400 | 8.38 |
| Embodiment 14 | 9.25 | 19.20 | 20.01 | 218 | 742 | 3.81 | 29950 | 8.39 |
| Embodiment 15 | 10.11 | 18.01 | 19.98 | 223 | 756 | 3.78 | 32830 | 8.38 |
| Embodiment 16 | 10.50 | 19.02 | 20.05 | 225 | 760 | 3.83 | 33450 | 8.39 |
| Contrastive example 1 | 10.85 | 27.10 | 28.35 | 120 | 650 | 1.86 | 2610 | 8.40 |
| Contrastive example 2 | 9.19 | 20.32 | 20.02 | 110 | 645 | 2.02 | 2530 | 8.41 |
| Contrastive example 3 | 8.54 | 23.07 | 17.69 | 160 | 680 | 2.02 | 2490 | 8.45 |
| Contrastive example 4 | 11.90 | 24.31 | 32.91 | 140 | 634 | 2.01 | 2530 | 8.40 |
| Contrastive example 5 | 9.04 | 20.12 | 20.01 | 172 | 675 | 2.78 | 15880 | 8.43 |

To sum up, addition of rare earth oxides in the magnetic material of the present invention significantly improves the mechanical properties of magnets, especially addition of 20 wt % of the rare earth oxides in the magnet materials which not only substantially improves the mechanical properties, but also greatly reduces the cost; addition of a proper amount of low-melting point Sn powders in the magnetic material of the present invention can reduce the sintering and densification temperature, generate denser sintered magnets and improve the remanence and mechanical properties of the magnets.

The present invention includes, but is not limited to, the rare earth-cobalt-based composite magnetic material described in Embodiments 1-16 and the preparation method thereof.

The embodiments described herein are intended for illustrating the spirit of the present invention only. Those skilled in the technical field of the present invention can make various modifications or additions or adopt similar alternatives to the embodiments described herein without departure from the spirit of the present invention or going beyond the definitions of the Claims attached.

What is claimed is:

1. A rare earth-cobalt-based composite magnetic material, comprising a mixture of two types of rare earth-cobalt-based materials and rare earth oxides, wherein the mass percent of the mixture of two types rare earth-cobalt-based materials is 40 wt %-98.55 wt %;

the rare earth oxides comprise endogenous rare earth oxides from an oxidization of the rare earth elements in the mixture of two types of rare earth-cobalt-based materials and added rare earth oxides, and the mass percent of the endogenous rare earth oxides in the rare earth-cobalt-based composite magnetic material does not exceed 3.0 wt %, wherein the total content of the oxygen introduced by the rare earth oxides is 3000 ppm-50000 ppm;

the content of the oxygen introduced by endogenous rare earth oxides in the rare earth-cobalt-based composite magnetic material does not exceed 5000 ppm, and the remaining oxygen content is introduced by addition of rare earth oxides;

the composite magnetic material is obtained by melting and casting each of the rare earth-cobalt-based materials separately into ingots, hydrogen decrepitation and addition of the added rare earth oxides, jet milling, blending, orientation and molding, cold isostatic pressing and heat treatment;

the rare earth oxides comprise element Co which is 0.1 wt %-10 wt % of the total mass of the rare earth oxides.

2. The rare earth-cobalt-based composite magnetic material as claimed in claim 1, further comprising Sn, wherein the content of Sn in the mixture of two types rare earth-cobalt-based materials does not exceed 10 wt %.

3. The rare earth-cobalt-based composite magnetic material as claimed in claim 1, wherein each of the rare earth-cobalt-based materials is melted and casted separately into ingots, the ingots include main alloy ingots A and auxiliary alloy ingots B which are all used to make the rare earth-cobalt-based composite magnetic material, the stoichiometric equation of chemical atoms of the main alloy ingots A is $(SmR_1)(CoM_1)z$, wherein $R_1$ is one or more of Y, La, Ce, Pr, Nd, Eu, Gd, Tb, Dy, Ho, Er, Tm, Yb and Lu, M1 is one or more of Fe, Cu, Zr, Mn, Ni, Ti, V, Cr, Zn, Nb, Mo, Hf, W and Sn, and z is 4.0-9.0;

the stoichiometric equation of chemical atoms of the auxiliary alloy ingots B is $(SmR_2)(CoM_2)y$, wherein $R_2$ is one or more of Y, La, Ce, Pr, Nd, Eu, Gd, Tb, Dy, Ho, Er, Tm, Yb and Lu, M2 is one or more of Fe, Cu, Zr, Mn, Ni, Ti, V, Cr, Zn, Nb, Mo, Hf, W and Sn, and y is 0.3-1.

4. The rare earth-cobalt-based composite magnetic material as claimed in claim 3, wherein the hydrogen decrepitation comprises the ingots absorbing hydrogen for 2 h-5 h at a decrepitation temperature of 10° C.-180° C. and a hydrogen pressure of 0.2 MPa-0.5 MPa, and then subjecting the ingots to vacuum dehydrogenation for 2 h-5 h at a temperature of 200° C.-600° C.

5. The rare earth-cobalt-based composite magnetic material as claimed in claim 4, wherein hydrogen decrepitated powders A and hydrogen decrepitated powders B are obtained from the main alloy ingots A and the auxiliary alloy ingots B through the hydrogen decrepitation, and at least one of the hydrogen decrepitated powders A and hydrogen decrepitated powders B has an average size of 10-500 microns.

6. The rare earth-cobalt-based composite magnetic material as claimed in claim 5, wherein rare earth oxides are added to the hydrogen decrepitated powders A and mixed with the same by stirring, and then jet milled to obtain magnetic powders D; the average size of the magnetic powders D is 2-6 microns.

7. The rare earth-cobalt-based composite magnetic material as claimed in claim 6, wherein the hydrogen decrepitated powders B are jet milled to obtain magnetic powders B; the average size of the magnetic powders B is 2-6 microns.

8. The rare earth-cobalt-based composite magnetic material as claimed in claim 7, wherein Sn powders E are added to the magnetic powders B and the magnetic powders D and blended for 3-6 h to obtain magnetic powders F; calculated as the mass fraction in the total raw materials of the rare earth-cobalt-based composite magnetic material, the amount of Sn powders added does not exceed 10 wt %, the amount of the magnetic powders B added does not exceed 10 wt %, and the sum of the amounts of both added does not exceed 10 wt %.

9. The rare earth-cobalt-based composite magnetic material as claimed in claim 8, wherein the magnetic powders F are oriented and molded; undergo the cold isostatic pressing to obtain blanks; and undergo heat treatment to obtain the rare earth-cobalt-based composite magnetic material, wherein the heat treatment process is that the blanks obtained from the cold isostatic pressing are heated to 1100° C.-1250° C. for 1-6 h heat treatment, cooled to 800° C.-1200° C. at a cooling rate of 0.1° C./min-4° C./min, maintained at the temperature for 0-5 h, and air-cooled to the room temperature.

10. The rare earth-cobalt-based composite magnetic material as claimed in claim 8, wherein the magnetic powders F are oriented and molded; undergo the cold isostatic pressing to obtain blanks; and undergo heat treatment to obtain the rare earth-cobalt-based composite magnetic material, wherein the heat treatment process is that the blanks obtained from the cold isostatic pressing are heated to 1100° C.-1250° C. for 1-6 h heat treatment, cooled to 800° C.-1200° C. at a cooling rate of 0.1° C./min-4° C./min, maintained at the temperature for not more than 15 h, and air-cooled to the room temperature, and then maintained at a temperature of 750° C.-900° C. for 5-40 h, slowly cooled to 350° C.-600° C. at a cooling rate of 0.1° C./min-4° C./min, maintained for not more than 10 h, and air-cooled to room temperature.

* * * * *